US007333102B2

(12) United States Patent
Nguyen

(10) Patent No.: US 7,333,102 B2
(45) Date of Patent: Feb. 19, 2008

(54) SELF-CONFIGURED DISPLAY POWER SUPPLY

(75) Inventor: Don J. Nguyen, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 657 days.

(21) Appl. No.: 10/750,182

(22) Filed: Dec. 31, 2003

(65) Prior Publication Data

US 2005/0156921 A1 Jul. 21, 2005

(51) Int. Cl.
*G09G 5/00* (2006.01)

(52) U.S. Cl. ..... 345/211; 345/213; 345/214; 345/95; 345/210

(58) Field of Classification Search ..... 345/211, 345/213, 214, 95, 210
See application file for complete search history.

(56) References Cited

U.S. PATENT DOCUMENTS 6,727,681 B2 * 4/2004 Morita ..... 323/282
6,927,989 B2 * 8/2005 Fukumoto ..... 363/95

FOREIGN PATENT DOCUMENTS

JP 11-284992 A * 10/1999

* cited by examiner

*Primary Examiner*—Richard Hjerpe
*Assistant Examiner*—Leonid Shapiro
(74) *Attorney, Agent, or Firm*—Robert A. Diehl

(57) ABSTRACT

A digital input power rail receives an input voltage for a display. A voltage regulator regulates the input voltage to a start-up voltage during a start-up period. After the start-up period, the voltage regulator regulates the input voltage to a steady-state voltage. The steady-state voltage is lower than the start-up voltage.

10 Claims, 6 Drawing Sheets

SELF-CONFIGURED DISPLAY POWER SUPPLY

FIELD OF THE INVENTION

The present invention relates to the field of voltage regulators. More specifically, the present invention relates to a self-configured display power supply.

BACKGROUND

Display devices, such as liquid crystal displays (LCD), often include voltage regulators to supply power to various components within the display. For example, in an LCD, a backlight illuminates the back side of an array of thin-film transistors. Each of the transistors in the thin-film array acts like a tiny shutter that can open or close to pass more or less light from the backlight. The amount of light passed by a transistor is controlled by the amount of voltage applied to it. In a typical display, 64 different levels of voltage may be applied to each transistor. Voltage regulators are usually used to provide these and other voltage levels in a display.

Each transistor may represent one tiny dot on an LCD, and an LCD may include hundreds of thousand, or even millions, of these tiny dots. By individually controlling the amount of light passed by each transistor, an image can be displayed on an LCD.

In order to coordinate so many levels of voltage applied to so many transistors, a great deal of control circuitry is often needed. The control circuitry in a display often consumes a relatively large amount of power in many devices. High power consumption can be undesirable, especially in mobile devices like laptop computers.

BRIEF DESCRIPTION OF DRAWINGS

Examples of the present invention are illustrated in the accompanying drawings. The accompanying drawings, however, do not limit the scope of the present invention. Similar references in the drawings indicate similar elements.

DETAILED DESCRIPTION OF THE INVENTION

In the following detailed description, numerous specific details are set forth in order to provide a thorough understanding of the present invention. However, those skilled in the art will understand that the present invention may be practiced without these specific details, that the present invention is not limited to the depicted embodiments, and that the present invention may be practiced in a variety of alternative embodiments. In other instances, well known methods, procedures, components, and circuits have not been described in detail.

Parts of the description will be presented using terminology commonly employed by those skilled in the art to convey the substance of their work to others skilled in the art. Also, parts of the description will be presented in terms of operations performed through the execution of programming instructions. As well understood by those skilled in the art, these operations often take the form of electrical, magnetic, or optical signals capable of being stored, transferred, combined, and otherwise manipulated through, for instance, electrical components.

Various operations will be described as multiple discrete steps performed in turn in a manner that is helpful for understanding the present invention. However, the order of description should not be construed as to imply that these operations are necessarily performed in the order they are presented, nor even order dependent. Lastly, repeated usage of the phrase "in one embodiment" does not necessarily refer to the same embodiment, although it may.

Various components in a typical display often consume a relatively large amount of power to get started, or initialized. For instance, reset circuitry, data driver capacitance loading, and in-rush current all consume power during a start-up period. In order to provide that power in a timely fashion, a relatively large voltage level is often provided by one or more voltage regulators.

Embodiments of the present invention, however, take advantage of the fact that, after the initial start-up period, certain display components may require less power. In which case, embodiments of the present invention can provide a higher voltage to one or more display components during the start-up period, and then drop down to a lower steady-state voltage thereafter. By dropping to a lower voltage level after the start-up period, embodiments of the present invention can reduce the overall power consumption of a display.

Although the present invention is primarily described below in the context of a laptop computer, embodiments of the present invention can be used in a variety of devices with displays such as video cameras, hand-held computing devices, cellular phones, computer tablets, automotive LCD displays, etc.

Figure 1:
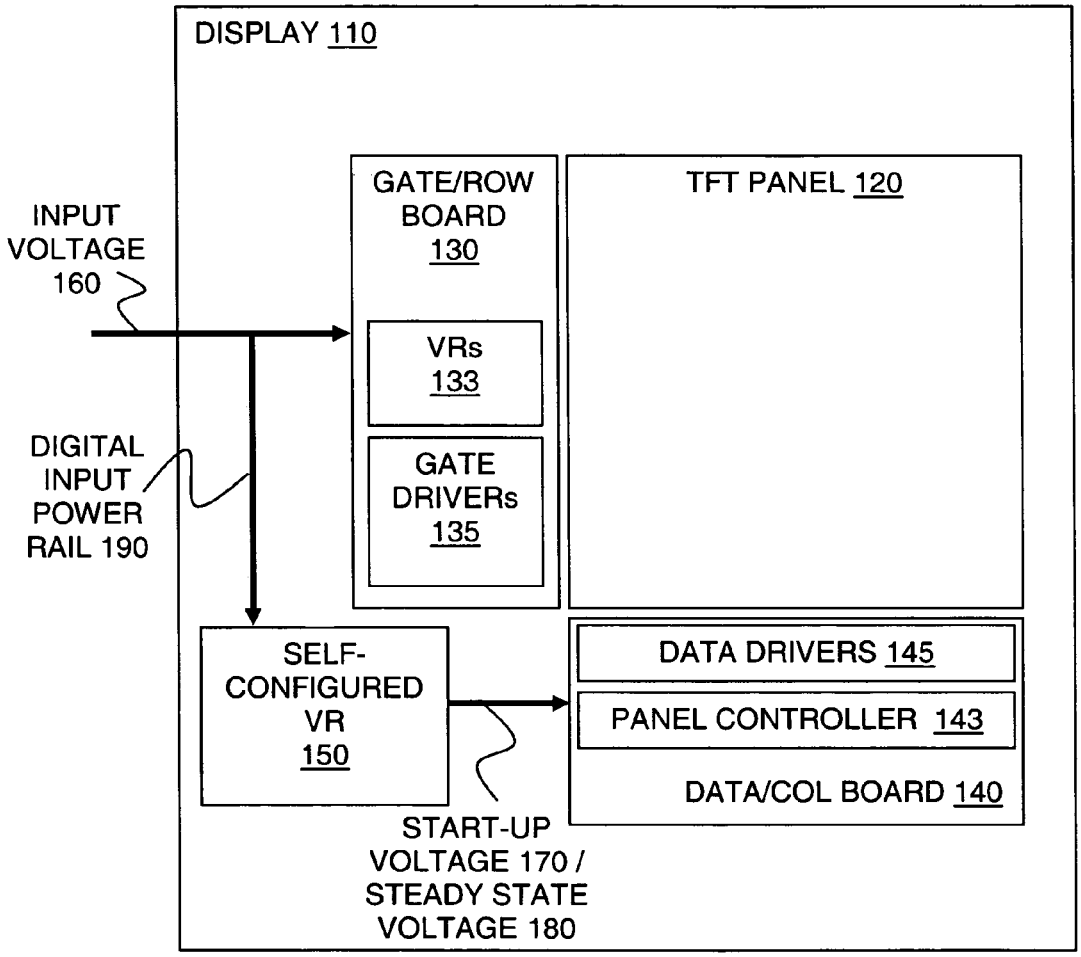
FIG. 1 illustrates one embodiment of a display.

FIG. 1 illustrates one embodiment of a display 110 according to the teachings of the present invention. Display 110 includes a thin-film transistor (TFT) array 120 that is controlled by gate/row board 130 and data/column board 140. Boards 130 and 140 perform a number of functions within display 110, such as applying voltages to TFT 120 in a coordinated manner to display images. Board 130 includes a number of voltage regulators (VRs) 133 and gate drivers 135. Board 140 includes a panel controller 143 and a number of data drivers 145. TFT 120 and boards 130 and 140 are intended to represent any of a wide variety of such devices and circuits commonly used in displays.

Display 110 receives an input voltage 160 to power the various components within the display. For example, a typical notebook computer provides 3.3 volts to its display. Certain digital components on the digital input power rail 190, however, may not require the full 3.3 volt power supply beyond an initial start-up period. In particular, in the illustrated embodiment, data/column board 140, including panel controller 143, could operate on 2.5 volts after the start-up period.

Therefore, in the illustrated embodiment, a self-configured voltage regulator 150 is inserted in the digital power rail before board 140. VR 150 is self-configured in that it can regulate the input voltage 160 to a start-up voltage during a start-up period, and then, of its own accord, regulate the input voltage to a lower, steady-state voltage after the start-up period. By dropping to a lower voltage, board 140 can consume less power and improve the overall efficiency of display 110.

The start-up voltage, the steady-state voltage, and the start-up period can be determined in any number of ways. For example, experiments can be performed to determine safe and sufficient voltage levels, as well as a safe and sufficient start-up period, for a particular display and input voltage. In certain embodiments, the start-up voltage may be equal to the input voltage. In other embodiments, the start-up voltage may be higher or lower than the input voltage.

Figure 2:
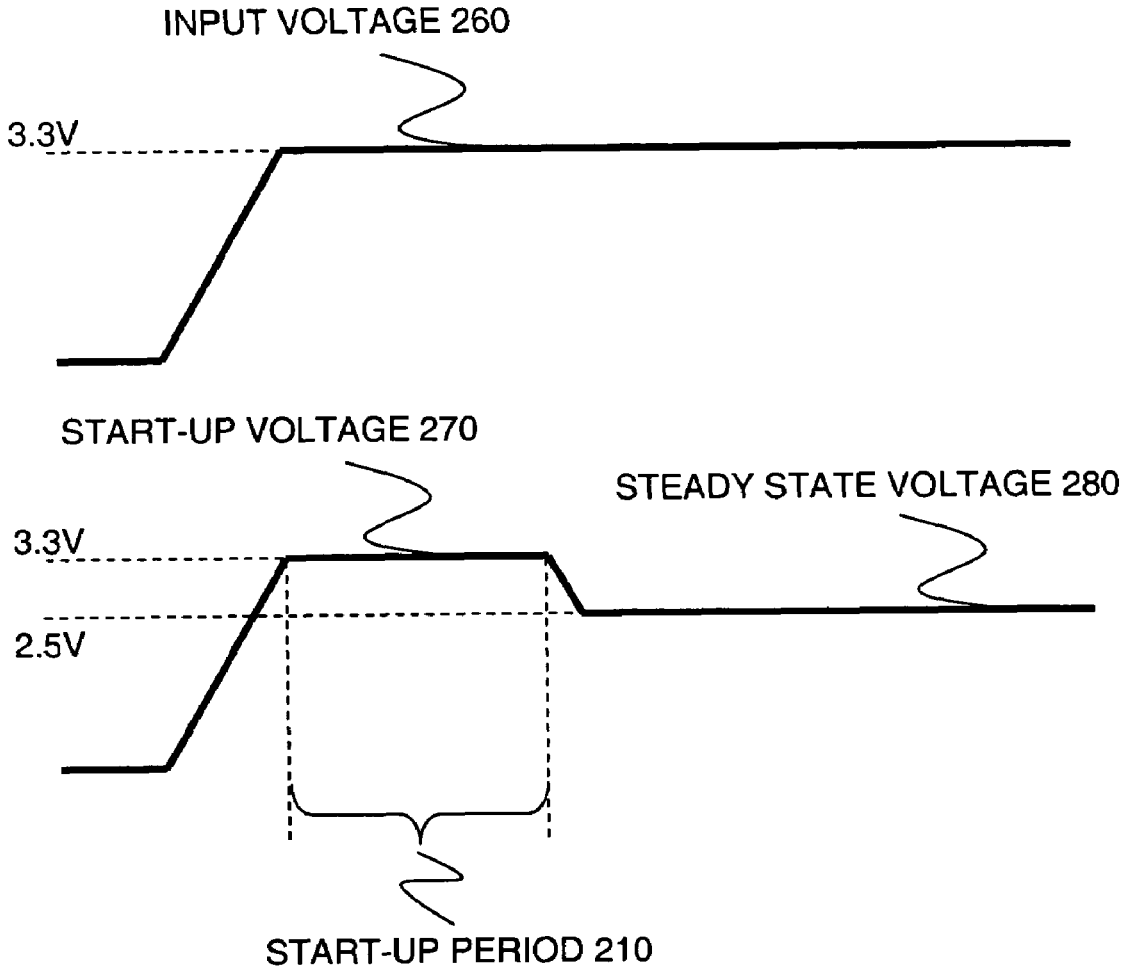
FIG. 2 illustrates one embodiment of voltage curves.

FIG. 2 illustrates voltage curves for one embodiment of a laptop computer display. In the illustrated embodiment, the top curve shows the input voltage 260 that could appear on the digital power rail 190 in FIG. 1. Voltage 260 rapidly ramps up to 3.3 volts and remains there. Fluctuations in the voltage may occur depending on the amount of power consumed at any instant in time, but the voltage level will generally tend to return to 3.3 volts.

The bottom curve shows the voltage that could appear at the output of voltage regulator 150 from FIG. 1. During the start-up period 210, the start-up voltage 270 follows the input voltage 260. Then, the steady state voltage drops to 2.5 volts after the start-up period. As with voltage 260, voltages 270 and 280 may also experience fluctuations.

Figure 3:
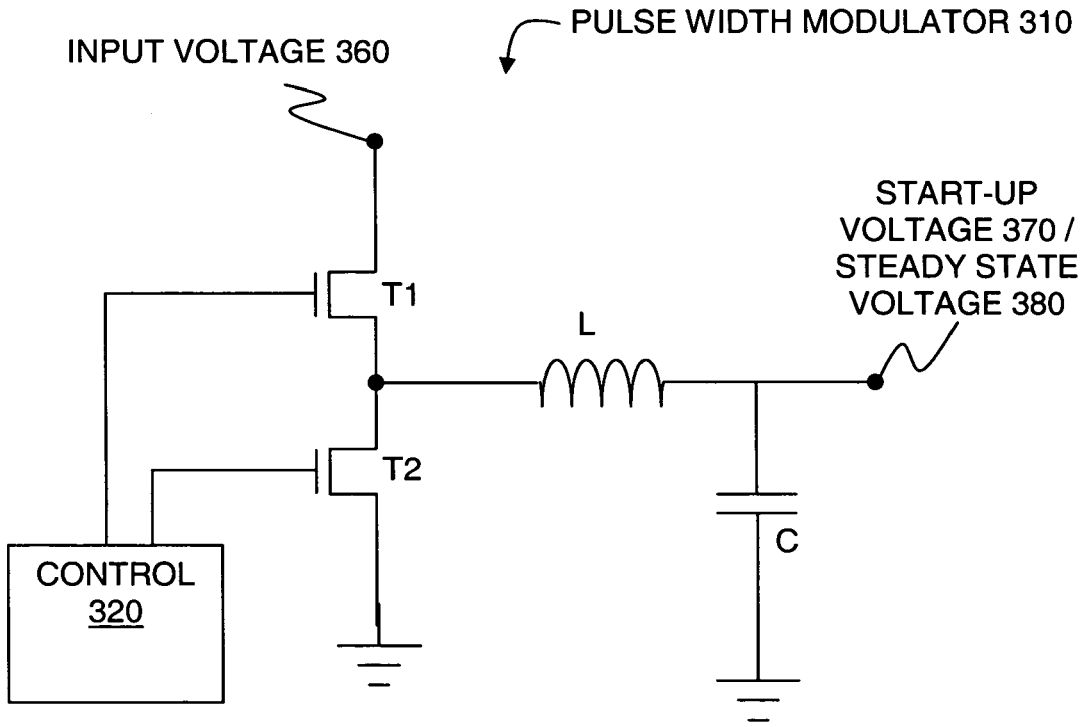
FIG. 3 illustrates one embodiment of a switching voltage regulator.

FIG. 3 illustrates one embodiment of a switching voltage regulator, or pulse width modulator 310, that could be used for voltage regulator 150 in FIG. 1. Modulator 310 includes transistors T1 and T2, inductor L, and capacitor C. With T1 closed and T2 open, the input voltage 360 is presented at the input side of the inductor L, causing the current in the inductor to ramp up, charging the output capacitor C. This continues until the output voltage reaches a predetermined value, at which time, T1 is opened and T2 is closed. With T1 open and T2 closed, the voltage at the input side of the inductor is connected to ground, causing the inductor current to ramp down, discharging the output capacitor C. Once the output voltage is lower than a predetermined value, T2 is turned off and T1 is turned on. Controller 320 can switch transistors T1 and T2 back and forth to alternately charge and discharge capacitor C. By switching the transistors at a particular frequency and adjusting the duty ratio for the transistors, controller 320 can regulate the voltage across capacitor C. That is, by closing T1 for longer or shorter portions of each cycle, controller 320 can increase or decrease the average voltage. Inductor L and capacitor C smooth out any rapid changes.

In order to regulate to start-up voltage 370, controller 320 may use a long duty ratio. For example, where start-up voltage 370 is approximately equal to input voltage 360, controller 320 may use a duty ratio of 1. That is, controller 320 may close T1 and open T2 during the entire start-up period. In practice, start-up voltage 370 may be slightly lower than input voltage 360 due to parasitic resistance in T1 and L.

Controller 320 may measure the start-up period in any number of ways. For example, the start-up period may be equal to a certain number of switching cycles. In which case, controller 320 can measure the start-up period by counting the cycles.

In any event, once the start-up period is over, controller 320 may change to a shorter duty ratio to regulate to the steady-state voltage 380. For example, if the target steady state voltage is 2.5 volts and the input voltage is 3.3 volts, controller 320 may use a duty ratio of approximately 2.5/3.3. That is, controller 320 may close T1 and open T2 about 76% of each cycle. As mentioned above, the duty ratio may be slightly more than 76% to account for parasitic resistance in the modulator 310.

Figure 4:
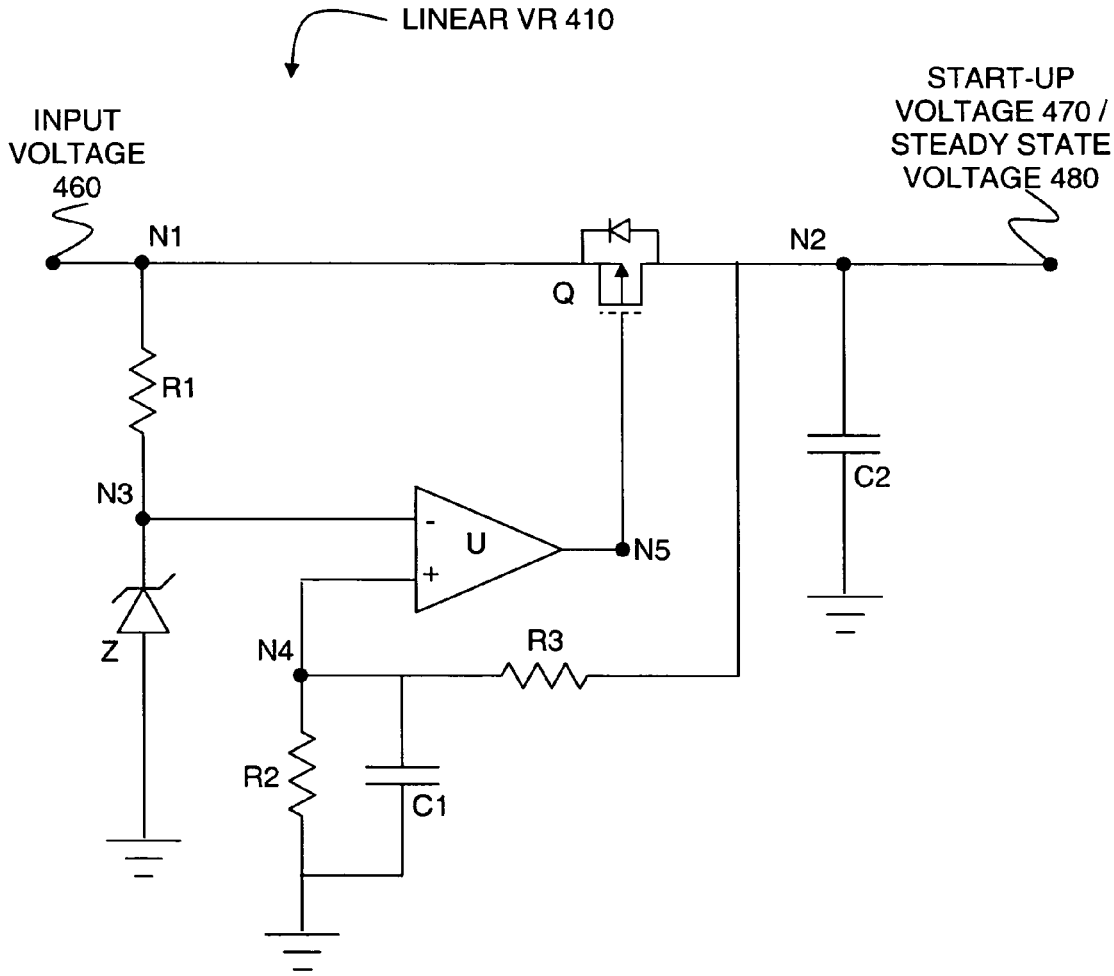
FIG. 4 illustrates one embodiment of a linear voltage regulator.

FIG. 4 illustrates one embodiment of a linear voltage regulator 410 that could be used for voltage regulator 150 in FIG. 1. Regulator 410 is built around a regulating unit Q, which provides a certain amount of isolation between nodes N1 and N2. Regulating unit Q can be any pass-element transistor. In the illustrated embodiment, Q is a p-channel metal oxide semiconductor field effect transistor (MOSFET) with its source coupled to N1, its drain coupled to N2, and its gate connected to a node N5. The input voltage 460 is received at node N1. The output is taken from node N2.

In addition to transistor Q, regulator 410 includes a number of resistive elements, capacitive elements, a bandgap reference element, and an operational amplifier or a voltage comparator. Specifically, resistor R1 is coupled between nodes N1 and N3, resistor R2 is coupled between node N4 and ground, and resistor R3 is coupled between nodes N2 and N4. Capacitor C1 is coupled between node N4 and ground, and capacitor C2 is coupled between node N2 and ground. The operational amplifier U has an inverting input coupled to node N3, a non-inverting input coupled to node N4, and an output coupled to node N5. In the illustrated embodiment, the bandgap reference element is a Zener diode Z.

R1 provides a biasing current to Z to establish a bandgap reference voltage at the inverting input of amplifier U. For an input of 3.3 volts, a start-up voltage of 3.3 volts, and a steady-state voltage of 2.5 volts, the bandgap reference voltage provided by diode Z may be 1.225 volts. R2 and R3 comprise a resistor-divider used to divide down the output voltage from node N2 prior to the non-inverting input of U. The output of U controls the biasing direction of Q to regulate to the steady-state output voltage 480. C2 filters the output voltage to reduce noise. C1 is the "timing" capacitor used along with R2 and R3 to provide the start-up period during which start-up voltage 470 is provided. Any number of approaches can be used to select the appropriate values for the various components to regulate to a variety of voltages and provide a desired start-up period.

Figure 5:
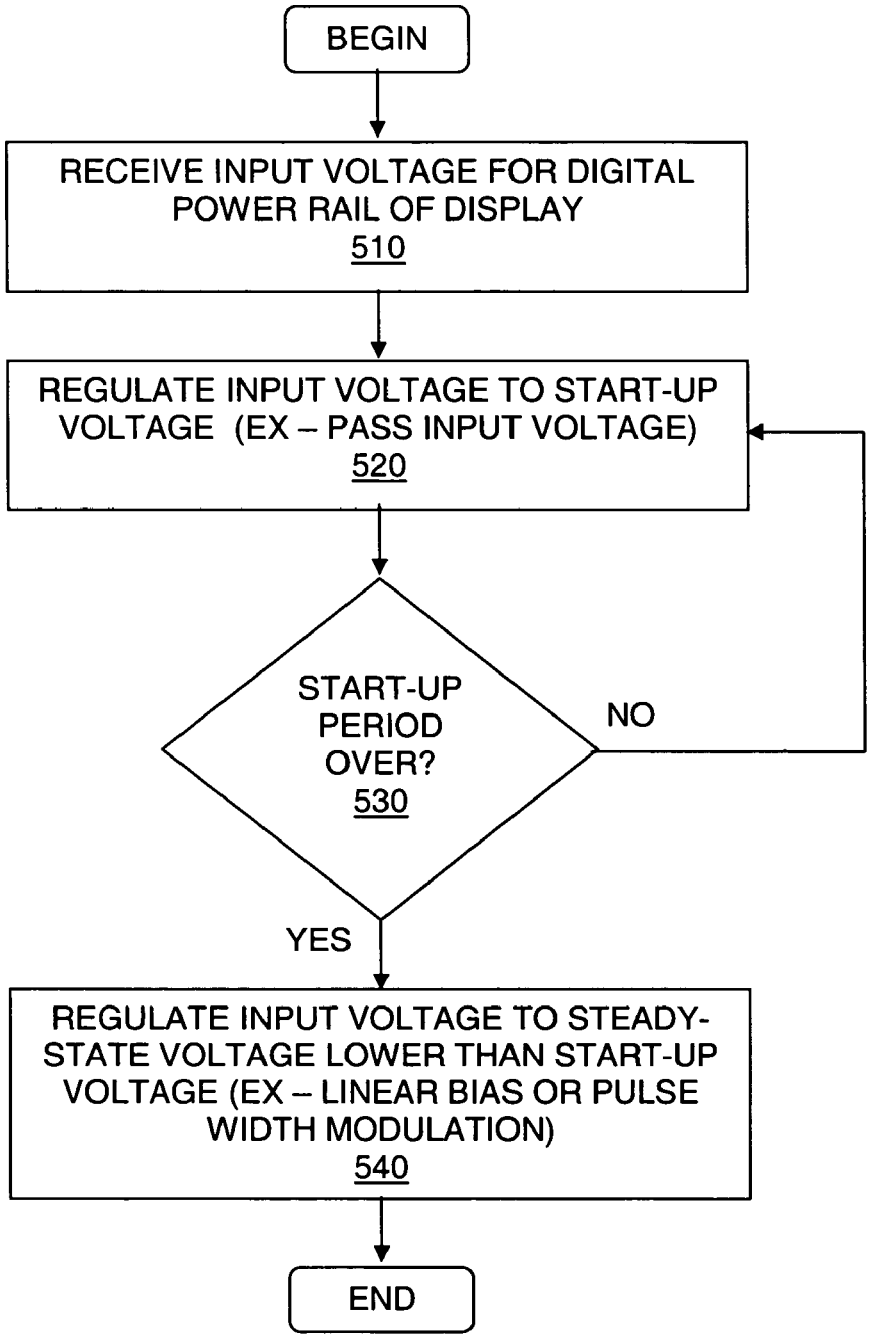
FIG. 5 demonstrates one embodiment of the present invention.

FIG. 5 demonstrates one embodiment of the present invention in the form of a process. As shown, the process starts by receiving an input voltage for a digital power rail of a display at 510. At 520, the process regulates the input voltage to a start-up voltage. For example, in the case of a switching regulator, such as the pulse width modulator from FIG. 3, this could involve passing the input voltage using a duty ratio of 1.

At 530, the process checks to see if the start-up period has expired. For example, in the case of the switching regulator, this could involve counting switching cycles. If the start-up period is not over, the process continues to provide the start-up voltage at 520. Once the start-up period ends, the process regulates the input voltage to the steady-state voltage at 540. This could involve, for instance, linearly biasing the voltage down after a capacitance-induced delay in a linear regulator, or modulating the pulse width down to a lower duty ratio in a switching regulator. The illustrated process could be repeated each time a display is powered up.

FIGS. 1-5 illustrate a number of implementation-specific details. Other embodiments may not include all of the illustrated elements, may include additional elements, may arrange elements in a different order, may combine one or more elements, and the like. Furthermore, any of a number of alternate hardware circuits can be used to perform the various functions described above. Or, one or more of the functions described above may be performed by code executed in a processor.

Figure 6:
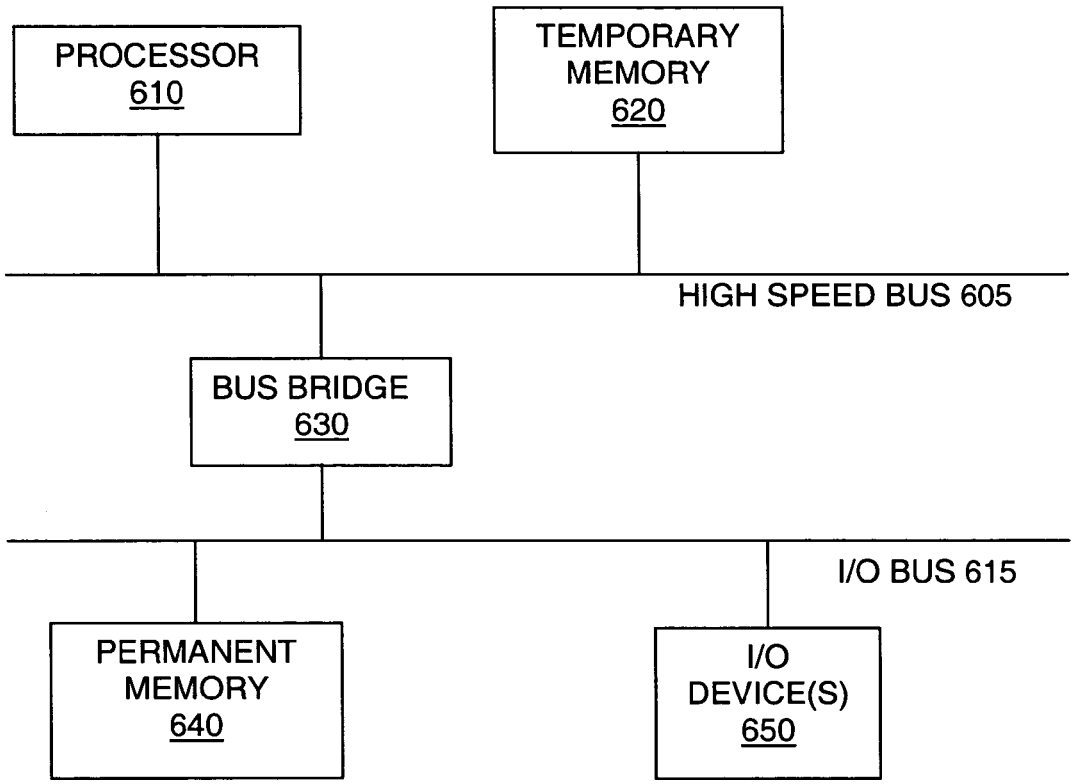
FIG. 6 illustrates one embodiment of a hardware system that can perform various functions of the present invention.

For example, FIG. 6 illustrates one embodiment of a generic hardware system intended to represent a broad category of computer systems such as personal computers, workstations, and/or embedded systems. In the illustrated embodiment, the hardware system includes processor 610 coupled to high speed bus 605, which is coupled to input/output (I/O) bus 615 through bus bridge 630. Temporary memory 620 is coupled to bus 605. Permanent memory 640 is coupled to bus 615. I/O device(s) 650 is also coupled to bus 615. I/O device(s) 650 may include a display device, a keyboard, one or more external network interfaces, etc.

Certain embodiments may include additional components, may not require all of the above components, or may combine one or more components. For instance, temporary memory 620 may be on-chip with processor 610. Alternately, permanent memory 640 may be eliminated and temporary memory 620 may be replaced with an electrically erasable programmable read only memory (EEPROM), wherein software routines are executed in place from the EEPROM. Some implementations may employ a single bus, to which all of the components are coupled, or one or more additional buses and bus bridges to which various additional components can be coupled. Similarly, a variety of alternate internal networks could be used including, for instance, an internal network based on a high speed system bus with a memory controller hub and an I/O controller hub. Additional components may include additional processors, a CD ROM drive, additional memories, and other peripheral components known in the art.

In one embodiment, various functions of the present invention, as described above, could be implemented using one or more hardware systems such as the hardware system of FIG. 6. Where more than one computer is used, the systems can be coupled to communicate over an external network, such as a local area network (LAN), an internet protocol (IP) network, etc. In one embodiment, one or more functions of the present invention as described above may be implemented as software routines executed by one or more execution units within the computer(s). For a given computer, the software routines can be stored on a storage device, such as permanent memory 640.

Figure 7:
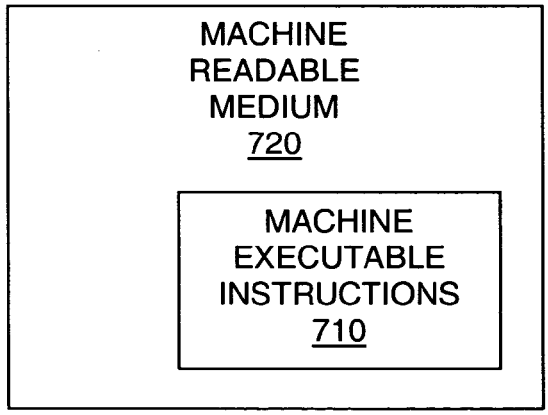
FIG. 7 illustrates one embodiment of a machine readable medium to store instructions that can implement various functions of the present invention.

Alternately, as shown in FIG. 7, the software routines can be machine executable instructions 710 stored using any machine readable storage medium 720, such as a hard drive, a diskette, CD-ROM, magnetic tape, digital video or versatile disk (DVD), laser disk, ROM, Flash memory, etc. The series of instructions need not be stored locally, and could be received from a remote storage device, such as a server on a network, a CD-ROM device, a floppy disk, etc., through, for instance, I/O device(s) 650 of FIG. 6.

From whatever source, the instructions may be copied from the storage device into temporary memory 620 and then accessed and executed by processor 610. In one implementation, these software routines are written in the C programming language. It is to be appreciated, however, that these routines may be implemented in any of a wide variety of programming languages.

In alternate embodiments, the embodiments of the present invention described above may be implemented in discrete hardware or firmware. For example, one or more application specific integrated circuits (ASICs) could be programmed with one or more of the above described functions. In another example, one or more functions of the present invention could be implemented in one or more ASICs on additional circuit boards and the circuit boards could be inserted into the computer(s) described above. In another example, field programmable gate arrays (FPGAs) or static programmable gate arrays (SPGA) could be used to implement one or more functions of the present invention. In yet another example, a combination of hardware and software could be used to implement one or more functions of the present invention.

Thus, a self-configured display power supply is described. Whereas many alterations and modifications of the present invention will be comprehended by a person skilled in the art after having read the foregoing description, it is to be understood that the particular embodiments shown and described by way of illustration are in no way intended to be considered limiting. Therefore, references to details of particular embodiments are not intended to limit the scope of the claims.

What is claimed is:

1. An apparatus comprising:

a digital input power rail to receive an input voltage for a display; and a voltage regulator to regulate the input voltage to a start-up voltage during a start-up period, and to regulate the input voltage to a steady-state voltage after the start-up period, said steady-state voltage being lower than the start-up voltage, wherein the voltage regulator comprises a pulse width modulator, wherein, to regulate the input voltage to the start-up voltage, the pulse width modulator switches the input voltage at a first duty ratio, and, to regulate the input voltage to the steady-state voltage, the pulse width modulator switches the input voltage at a second duty ratio, and wherein the first duty ratio is 1.

2. An apparatus comprising:

a digital input power rail to receive an input voltage for a display; and a voltage regulator to regulate the input voltage to a start-up voltage during a start-up period, and to regulate the input voltage to a steady-state voltage after the start-up period, said steady-state voltage being lower than the start-up voltage, wherein the voltage regulator comprises a pulse width modulator, wherein, to regulate the input voltage to the start-up voltage, the pulse width modulator switches the input voltage at a first duty ratio, and, to regulate the input voltage to the steady-state voltage, the pulse width modulator switches the input voltage at a second duty ratio, and wherein the second duty ratio is 2.5/3.3.

3. An apparatus comprising:

a digital input power rail to receive an input voltage for a display; and a voltage regulator to regulate the input voltage to a start-up voltage during a start-up period, and to regulate the input voltage to a steady-state voltage after the start-up period, said steady-state voltage being lower than the start-up voltage, wherein the voltage regulator comprises a linear voltage regulator, and wherein the linear voltage regulator comprises:

a regulating component coupled between a first node and a second node, said first node comprising the digital input power rail, said second node comprising an output power rail;

a first resistive element coupled between the first node and a third node;

a bandgap reference element coupled between a ground node and the third node;

an operational amplifier having an inverting input coupled to the third node, a non-inverting input coupled to a fourth node, and an output coupled to a fifth node;

a second resistive element coupled between the fourth node and the ground node;

a third resistive element coupled between the second node and the fourth node;

a first capacitive element coupled between the fourth node and the ground node; and a second capacitive element coupled between the second node and the ground node.

4. The apparatus of claim 3 wherein the regulating component comprises a pass-element transistor.

5. The apparatus of claim 4 wherein the pass-element transistor comprises a p-channel metal oxide semiconductor field effect transistor (MOSFET).

6. The apparatus of claim 3 wherein the regulating component is to provide isolation between the first and second nodes.

7. The apparatus of claim 3 wherein the bandgap reference element comprises a Zener diode.

8. The apparatus of claim 3 wherein the input voltage is 3.3 volts, the steady-state voltage is 2.5 volts, and the bandgap reference element provides a reference voltage of 1.225 volts.

9. The apparatus of claim 3 wherein the first capacitive element provides the start-up period.

10. A system comprising:

a liquid crystal display (LCD); and a power supply coupled to the LCD, said power supply comprising:

a digital input power rail to receive an input voltage for the LCD; and a voltage regulator to regulate the input voltage to a start-up voltage during a start-up period, and to regulate the input voltage to a steady-state voltage after the start-up period, said steady-state voltage being lower than the start-up voltage, wherein the voltage regulator comprises a linear voltage regulator, and wherein the linear voltage regulator comprises:

a regulating component coupled between a first node and a second node, said first node comprising the digital input power rail, said second node comprising an output power rail;

a first resistive element coupled between the first node and a third node;

a bandgap reference element coupled between a ground node and the third node;

an operational amplifier having an inverting input coupled to the third node, a non-inverting input coupled to a fourth node, and an output coupled to a fifth node;

a second resistive element coupled between the fourth node and the ground node;

a third resistive element coupled between the second node and the fourth node;

a first capacitive element coupled between the fourth node and the ground node; and a second capacitive element coupled between the second node and the ground node.

* * * * *